US005973284A

United States Patent [19]

Takenaka et al.

[11] Patent Number: 5,973,284

[45] Date of Patent: Oct. 26, 1999

[54] PUSH BUTTON SWITCH ASSEMBLY WITH SNAP ACTION MOVABLE BRIDGING CONTACT

[75] Inventors: Takuo Takenaka, Kyoto; Yasuchika Kudo, Obama, both of Japan

[73] Assignee: Matsushita Electric Industrial Co., Ltd., Osaka, Japan

[21] Appl. No.: 09/090,915

[22] Filed: Jun. 5, 1998

[30] Foreign Application Priority Data

Jun. 11, 1997 [JP] Japan ..... 9-153349

[51] Int. Cl.[6] ..... H01H 13/36

[52] U.S. Cl. ..... 200/532; 200/448

[58] Field of Search ..... 200/402–472, 200/520–536, 341–345

[56] References Cited

U.S. PATENT DOCUMENTS

| | | | |
|---|---|---|---|
| 3,612,793 | 10/1971 | Roeser | 200/409 |
| 3,898,402 | 8/1975 | Ford | 200/448 |
| 4,720,609 | 1/1988 | Hochgesang et al. | 200/5 A |
| 4,814,558 | 3/1989 | Tanabe | 200/440 |
| 4,916,269 | 4/1990 | Spazierer et al. | 200/408 |
| 5,201,824 | 4/1993 | Kato et al. | 200/520 |
| 5,566,819 | 10/1996 | Lustgarten et al. | 200/407 |
| 5,651,452 | 7/1997 | Schaeffeler et al. | 200/437 |
| 5,667,062 | 9/1997 | Yasufuku et al. | 200/536 |

*Primary Examiner*—J. R. Scott

*Attorney, Agent, or Firm*—Pollock, Vande Sande & Amernick

[57] ABSTRACT

A push-button switch for use in electronic devices is provided which reduces stress on contact parts. A C-shaped elastic member is secured at one end to a bottom wall of a switch casing and engages a movable member at its other end. The movable member in turn pivotably engages a contact member having movable elastic arms which abut non-conducting inclined surfaces on the bottom wall of the casing when the switch is open. To close the switch, a knob disposed slidably within the casing is depressed, bringing a bottom surface of the knob into engagement with an end of the movable member and deforming the C-shaped elastic member by bringing its ends closer together. Further, the contact member is caused to pivot about the movable member and move toward the bottom wall of the casing. Consequently, the movable elastic arms of the contact member slide off the inclined surfaces and into electrical contact with stationary contacts in the bottom wall of the switch casing to form a conductive path. The stresses incident to closing the switch are diffused by the C-shaped elastic member, reducing stress on the contact member and consequently reducing breakage of the contact member.

8 Claims, 6 Drawing Sheets

PUSH BUTTON SWITCH ASSEMBLY WITH SNAP ACTION MOVABLE BRIDGING CONTACT

BACKGROUND OF THE INVENTION

1. Technical Field of the Invention

The present invention relates generally to an improved structure of a push-button switch for use in electronic devices which achieves a long service life and operates with high reliability and confidence levels.

2. Background of Related Art

FIGS. 9 and 10 show a conventional push-button switch which includes generally a box-like resinous casing 1, a stationary contact 2, a holder 3, a cover 4, a button or knob 5, and a spring plate 6.

The stationary contact 2 and the holder 3 are secured on an inner bottom wall of the casing 1. The cover 4 is connected to the casing 1 in a snap fit of a claw 1A of the casing 1 into a hole 4B of the cover 4 and has an upper opening 4A through which the knob 5 slides vertically, as viewed in the drawing, when a knob head 5A is depressed downward.

The spring plate 6 includes a movable contact 6A, a supporting portion 6B, and a flexible strip 6C. The supporting portion 6B is secured in a recess 3A of the holder 3. The flexible strip 6C is held at its end in a recess 3B of the holder 3 to urge the movable contact 6A into constant engagement with the bottom of the knob 5.

In operation, when the knob head 5A is, as shown in FIG. 10, pushed down by a finger pressure of an operator, it will cause the spring plate 6 to be turned about a junction of the recess 3A and the support portion 6B into engagement of an end of the movable contact 6A with an end of the stationary contact 2, thereby establishing an electrical connection of the holder 3 and the stationary contact 2.

When the finger pressure is released from the knob head 5A, it will cause the flexible strip 6C of the spring plate 6 to be urged elastically upward to lift the knob 5 up to its initial position, thereby moving the movable contact 6A out of engagement with the stationary contact 2 to block the electrical connection of the holder 3 and the stationary contact 3.

The above conventional push-button switch, however, has the following drawback.

During the turning on and off operations of the push-button switch, the stress concentrates at a base of the flexible strip 6C of the spring plate 6, which leads to concern about breakage of the flexible strip 6C. An increase in rigidity of the flexible strip 6C of the spring plate 6 in order to avoid such a problem also leads to an increase in size of the spring plate 6, thus resulting in an increase in overall size and weight of the push-button switch.

SUMMARY OF THE INVENTION

It is therefore a principal object of the present invention to avoid the disadvantages of the prior art.

It is another object of the present invention to provide a compact and inexpensive push-button switch which achieves a long service life and operates with high reliability and confidence levels.

According to one aspect of the present invention, there is provided a push-button switch which comprises: (a) a casing having an upper opening, a side wall, and a bottom wall, the casing defining therein a chamber; (b) stationary contacts mounted in the chamber of the casing; (c) a holder made of a C-shaped elastic member having a first end portion and a second end portion, the holder connecting at its first end portion thereof with the bottom wall of the casing; (d) a movable member having a first end portion and a second end portion, the movable member connecting at its second end portion with the second end portion of the holder; (e) a contact member having elastic arms on ends of which movable contacts are formed, the contact member having a first end portion and a second end portion and connecting at its first end portion with the first end portion of the movable member and at its second end portion with the first end portion of the holder so as to support the movable contacts at a given interval away from the stationary contacts, respectively; and (f) a knob disposed slidably in the chamber of the casing with a head projecting from the upper opening, the knob having a bottom wall in engagement with the movable member, when the head is depressed, the bottom wall of the knob urging the movable member to bring the movable contacts into electrical engagement with the stationary contacts while deforming the holder elastically.

In the preferred mode of the invention, when the head of the knob is depressed, the bottom of the knob urges the movable member to bring the movable contacts into electrical engagement with the stationary contacts while moving the second end portion of the holder close to the first end portion of the holder.

The movable contacts of the contact member are in contact with inclined surfaces formed on the bottom wall of the casing so that when the head of the knob is depressed, the movable contacts of the contact member slide along the inclined surfaces and engage the stationary contacts to establish electrical communication between the stationary contacts.

The knob has formed therein a chamber within which the holder is disposed.

The first end portion of the holder may continue from an end of one of the stationary contacts.

The casing may have a protrusion formed on an inner end surface of the side wall. The knob may have a protrusion formed on an outer surface a protrusion which engages the protrusion of the casing within the chamber of the casing. The protrusion of the knob engages the protrusion of the casing against a spring pressure produced by the movable member and the contact member.

According to another aspect of the invention, there is provided a process of fabricating a push-button switch including (a) a casing having an upper opening, a side wall, and a bottom wall, the casing defining therein a chamber, (b) stationary contacts mounted in the chamber of the casing, (c) a holder made of a C-shaped elastic member having a first end portion and a second end portion, the holder connecting at its first end portion with the bottom wall of the casing, (d) a movable member having a first end portion and a second end portion, the movable member connecting at its second end portion with the second end portion of the holder, (e) a contact member having elastic arms on ends of which movable contacts are formed, the contact member having a first end portion and a second end portion and connecting at its first end portion with the first end portion of the movable member and at the second end portion with the first end portion of the holder so as to support the movable contacts at a given interval away from the stationary contacts, respectively, and (f) a knob disposed slidably in the chamber of the casing with a head projecting from the upper opening, the knob having a bottom wall in engagement with the movable member, when the head is depressed, the bottom wall of the knob urging the movable member to bring the movable contacts into electrical engagement with the stationary contacts while deforming the holder elastically. The process comprises the steps of: (1) forming the movable member and the contact member using a single plate doubled up at a bent portion; (2) connecting the holder to the single plate; and (3) cutting the bent portion of the single plate to divide the single plate into the movable member and the contact member.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for explanation and understanding only.

In the drawings:

FIG. 5 is a cross sectional view which shows a push-button switch when turned on;

FIG. 8(*b*) is a cross sectional view which shows a contact assembly consisting of the holder and the single plate as shown in FIG. 8(*a*);

FIG. 10 is a cross sectional view which shows the conventional push-button switch in FIG. 9 when turned on.

DESCRIPTION OF THE PREFERRED EMBODIMENT

Figure 1:
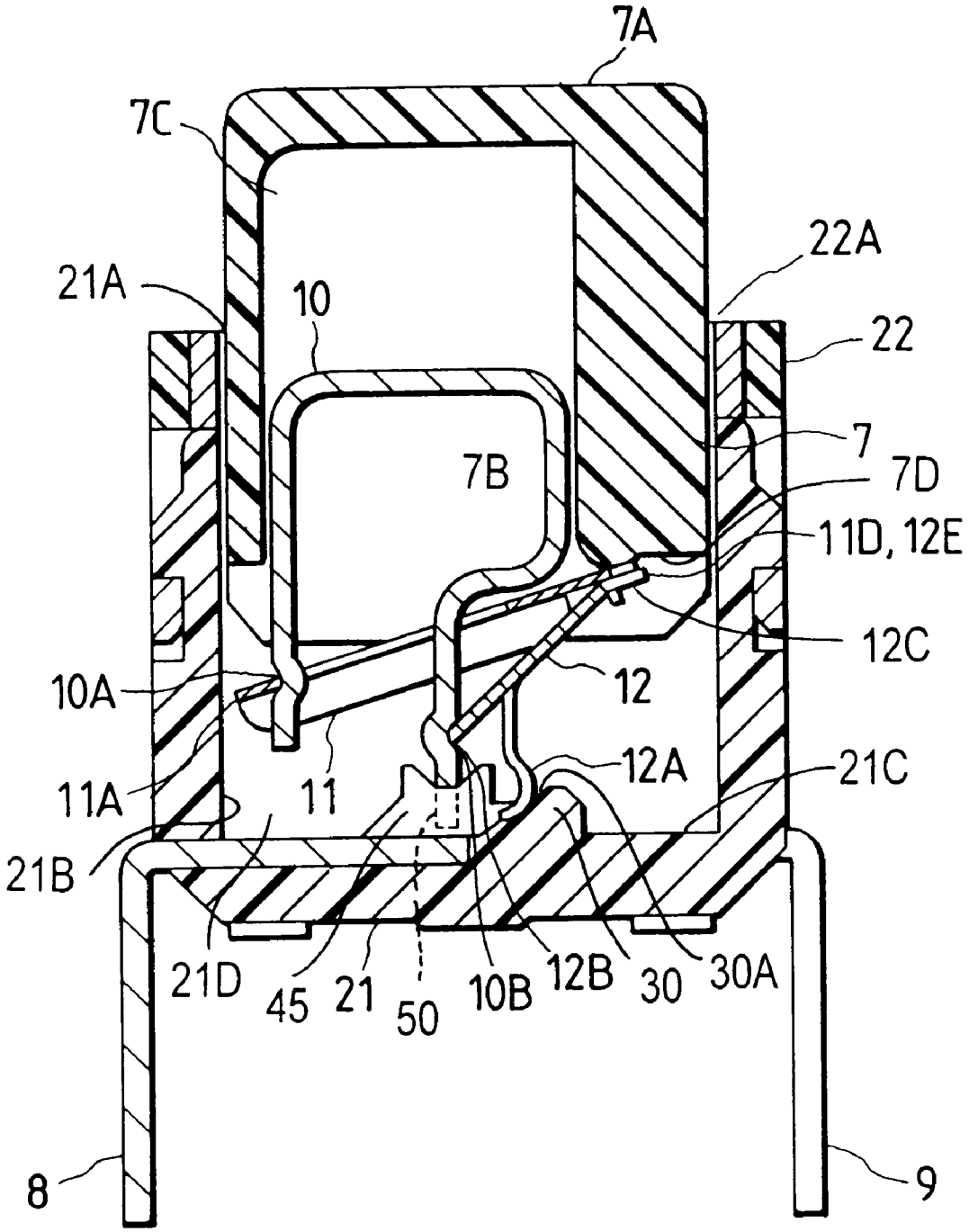
FIG. 1 is a cross sectional view which shows a push-button switch according to the first embodiment of the invention.

Referring now to the drawings, wherein like reference numbers refer to like parts throughout several views, and referring now particularly to FIG. 1, there is shown a push-button switch according to the first embodiment of the present invention.

Figure 2:
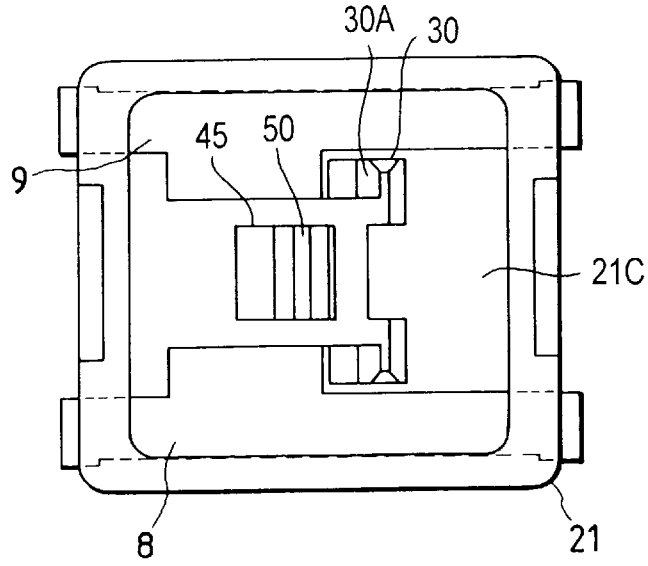
FIG. 2 is a plane view which shows stationary contacts mounted on a bottom of a casing.

The push-button switch includes generally a box-like casing 21, a cover 22, a knob 7, and a pair of stationary contacts 8 and 9. The casing 21 is made of resin and has an upper opening. 21A, and a side wall 21B and bottom wall 21C forming a chamber 21D. The cover 22 has a central opening 22A and is disposed on an upper end of the casing 21. The cover 22 has protrusions (not shown) formed on an inner wall. The knob 7 is disposed in the casing 21 slidably in a vertical direction, as viewed in the drawing, through the opening 22A of the cover 22 in engagement of vertical grooves (not shown) formed in a peripheral wall constituting an outer side wall of knob 7, with the protrusions of the cover 22 to avoid dislodgment from the casing 21. The stationary contacts 8 and 9 are, as shown in FIG. 2, made of strip members and mounted in an inner bottom wall of the casing 21. The knob 7 has a knob head 7A projecting from the opening 22A of the cover 22.

Figure 3:
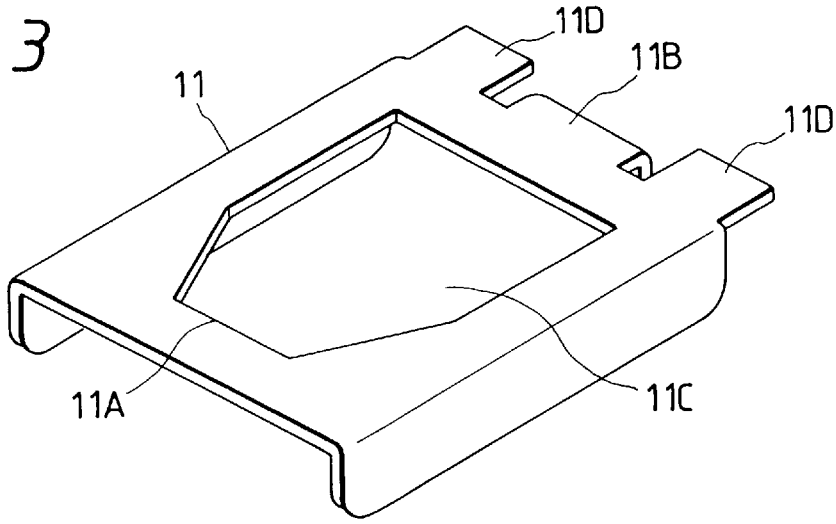
FIG. 3 is a perspective view which shows a movable member.
Figure 4:
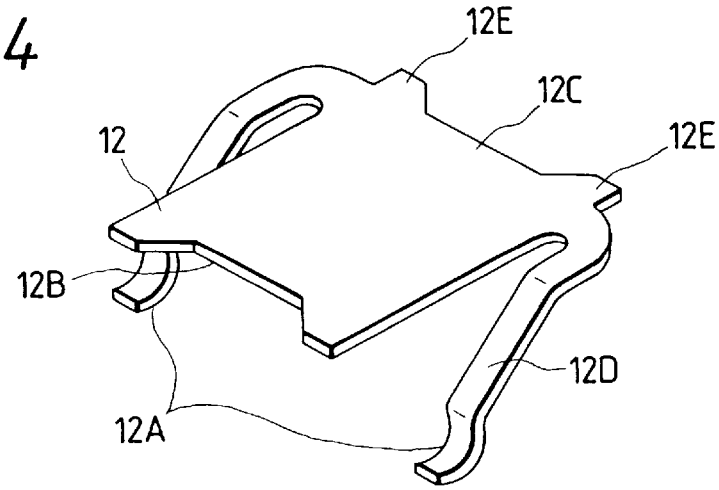
FIG. 4 is a perspective view which shows a contact member.

The push-button switch also includes a holder 10, a movable member 11, and a contact member 12. The holder 10 is made of a C-shaped metallic plate without any sharp comers for avoiding concentration of stress and is secured at one end in slot 50 in retaining structure 45 on the inner bottom wall of the casing 21. The holder 10 has curved portions (i.e., grooves) 10A and 10B formed on its ends. The curved portion 10A formed on the free end of the holder 10 is located above the curved portion 10B in the drawing. The movable member 11 is, as clearly shown in FIG. 3, made of a plate member and has formed therein an opening 11C. The movable member 11 also has an L-shaped end portion 11B which is bent downward. The contact member 12 is, as shown in FIG. 4, made of a metallic plate and has a pair of flexible side arms 12D bent downward, as viewed in the drawing, which have C-shaped ends forming movable contacts 12A. The contact member 12 has cut-out ends 12B and 12C. The cut-out end 12C, as shown in FIG. 1, pivotably engages the L-shaped end portion 11B of the movable member 11, and the cut-out portion 12B engages the curved portion 10B of the holder 10 so as to urge the movable contacts 12A elastically into constant engagement with inclined surfaces of protrusions 30 formed on the inner bottom wall of the casing 21. The movable member 11 is retained by the holder 10 in engagement of an inner edge 11A of movable member 11 with the curved portion 10A of the holder 10.

Figure 5:
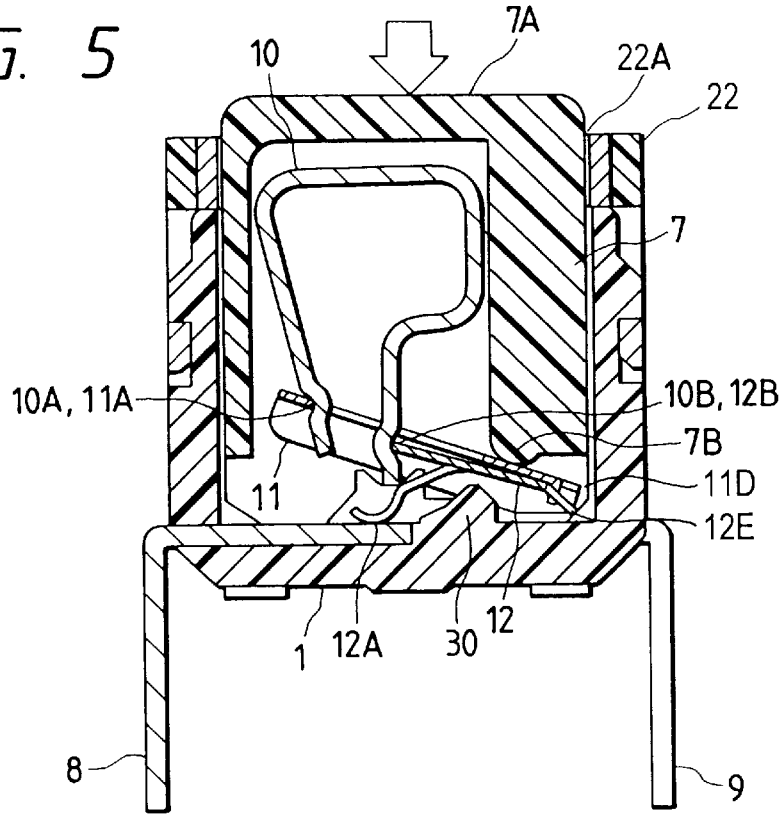

In operation, when the push-button switch is turned on, the knob head 7A projecting from the opening 22A of the cover 22 is depressed downward, as shown in FIG. 5. This causes the right ends 11D of the movable member 11 and the right ends 12E of the contact member 12 to be urged elastically downward by a protrusion 7B formed on a bottom surface 7D of the knob 7 so that they are turned clockwise about a support point where the cut-out portion 12B of the contact member 12 is in contact with the curved portion 10B of the holder 10 while drawing the free end of the holder 10 inward through the inner edge 11A of the movable member 11. This causes the movable contacts 12A to slide to the left along the inclined surfaces 30A of the protrusions 30 on the inner bottom wall of the casing 21 into electric engagement with the stationary contacts 8 and 9, respectively.

When the push-button switch is turned off, the depression pressure acting on the knob head 7A is released. This causes the movable contact 11 and the contact member 12 to be returned to their initial positions by an elastic restoring force of the holder 10 so that the movable contacts 12A are moved out of electrical engagement with the stationary contacts 8 and 9, respectively.

As apparent from the above discussion, when the push-button switch is either turned on or off, the C-shaped holder 10 is only deformed inward or outward elastically without concentration of stress, thus avoiding the problem of parts breakage encountered by the conventional push-button switch as discussed in the introductory part of this application.

The knob 7 has formed therein a storage chamber 7C in which the holder 10 is stored without interfering with the vertical movement of the knob 7 when the push-button switch is turned on and off. This, therefore, allows the overall height of the push-button switch to be decreased by the vertical movement of the knob 7 as compared with the conventional push-button switch.

When the push-button switch is turned on and off, the movable contacts 12A, as described above, slide on the stationary contacts 8 and 9, thereby cleaning the surfaces of the movable contacts 12A and the stationary contacts 8 and 9. This ensures the stability of electrical engagement between the movable contacts 12A and the stationary contacts 8 and 9.

The movable contacts 12A are, as clearly shown in FIG. 4, provided on the flexible side arms 12D of the contact member 12. The level of spring pressure produced by the contact member 12 to establish the electrical engagement of the movable contacts 12A with the stationary contacts 8 and 9 may, thus, be determined regardless of the flexibility of the holder 10. Specifically, the spring pressure produced by the contact member 12 may be set easily based on voltage or current used in the push-button switch or any other circuit specifications.

Figure 6:
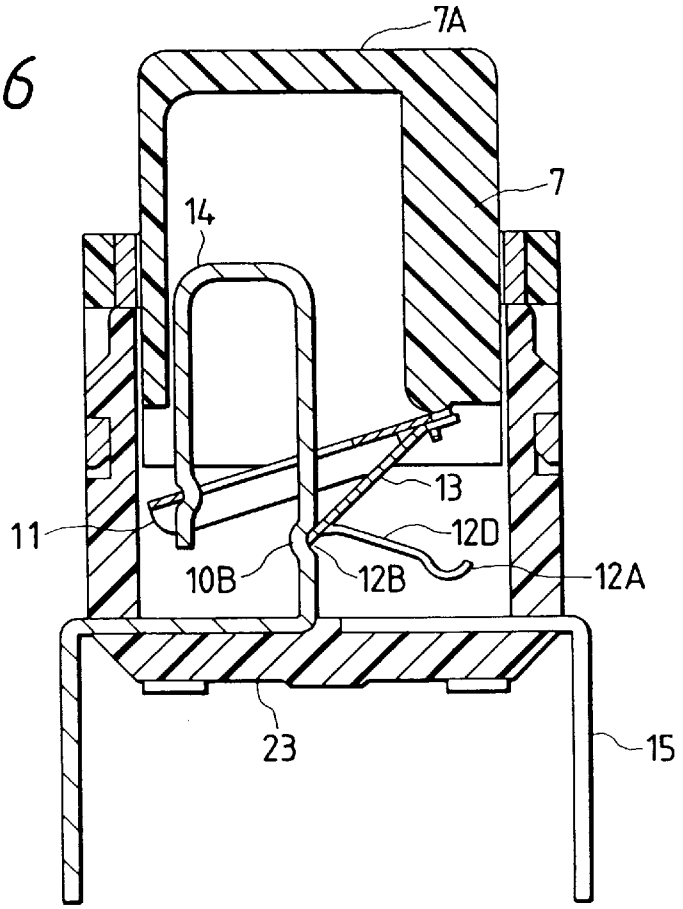
FIG. 6 is a cross sectional view which shows a push-button switch according to the second embodiment of the invention.

FIG. 6 shows a push-button switch according to the second embodiment of the invention which is different from the first embodiment in structure of a contact member 13, a holder 14, a pair of stationary contacts 15, and a casing 23.

The holder 14 is made of a C-shaped strip member connecting integrally with one of the stationary contacts 15 inserted into the bottom of the casing 23. The side arms 12D of the contact member 13 extend in a direction opposite the direction in which the side arms 12D of the contact member 12 of the first embodiment extend, as shown in FIG. 4, so that the movable contacts 12A are located just above portions of the stationary contacts 15 with a given contact gap. The casing 23 does not have protrusions on an inner bottom surface thereof like the protrusion 30 shown in FIG. 1. Other arrangements are identical with those of the first embodiment, and explanation of the other arrangement in detail will be omitted here.

In operation, when the push-button switch is turned on, the knob head 7A is depressed downward to elastically urge the right ends of the movable member 11 and the contact member 13 downward, similar to the first embodiment. This causes the movable member 11 and the contact member 13 to be turned clockwise about a support point where the cut-out portion 12B of the contact member 13 engages the curved portion 10B of the holder 14 to urge the movable contacts 12A elastically into electrical engagement with upper surfaces of the stationary contacts 15.

The turning off of the push-button switch is achieved by releasing the depression of the knob head 7A, and explanation in detail will be omitted here.

The holder 14 is, as described above, formed integrally with one of the stationary contacts 15, thus resulting in a decrease in parts making up the push-button switch and also allowing the holder 14 to be mounted on the inner bottom surface of the casing 23 simultaneously with installation of the stationary contact 15. This facilitates ease of assembling operations of the push-button switch.

Figure 7:
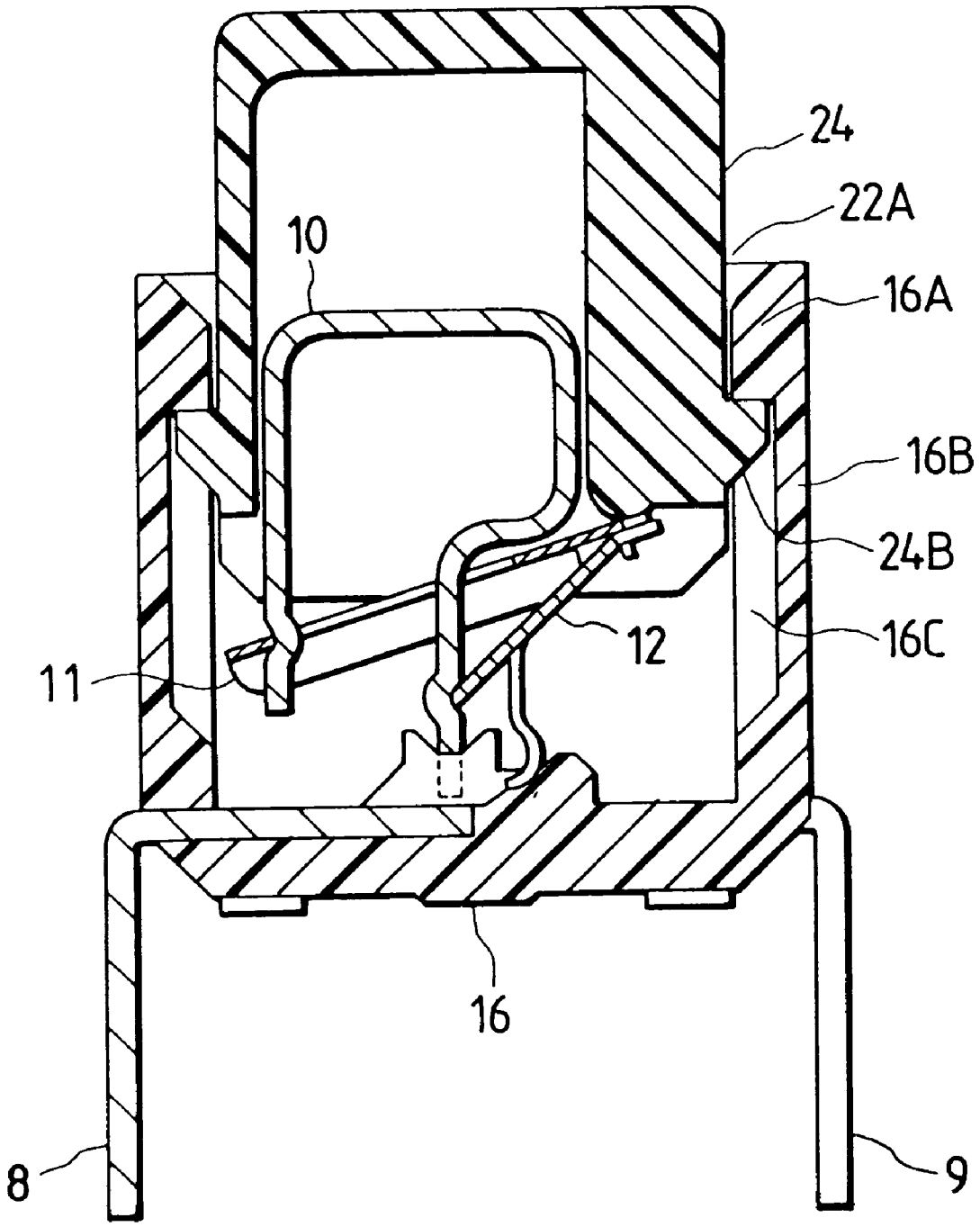
FIG. 7 is a cross sectional view which shows a push-button switch according to the third embodiment of the invention.

FIG. 7 shows a push-button switch according to the third embodiment of the invention which is different from the first embodiment in structure of a casing 16 and a knob 24.

The casing 16 is made of a box-like resinous member and has a pair of vertical grooves 16C formed in inner side walls opposed to each other. Formed at an upper end of each of the vertical grooves 16C is a barb-like protrusion 16A. The knob 24 has outer end portions having a pair of barb-like protrusions 24B which are slidably disposed in the vertical grooves 16C of the casing 16 and which are urged by a spring pressure of the contact member 12 into constant engagement with the bottom walls of the barb-like protrusions 16A. Other arrangements are identical with those of the first embodiment, and explanation in detail will be omitted here.

In assembling of the push-button switch, the stationary contacts 8 and 9 are first mounted in the inner bottom wall of the casing 16. The holder 10, the movable member 11, and contact member 12 are assembled together. One end of the holder 10 is inserted at into the inner bottom wall of the casing 16. The knob 24 is forced elastically into the casing 16 through the upper opening 22A so that the barb-like protrusions 24B of the knob 24 may be fitted into the vertical grooves 16C, respectively. Upon entering the vertical grooves 16C, the barb-like protrusions 24B are urged upward by the spring pressure of the contact member 12 into constant engagement with the barb-like protrusions 16A of the casing 16.

The structure of this embodiment eliminates the use of the cover 22 of the above embodiments, thus decreasing parts making up the push-button switch.

Figure 8A:
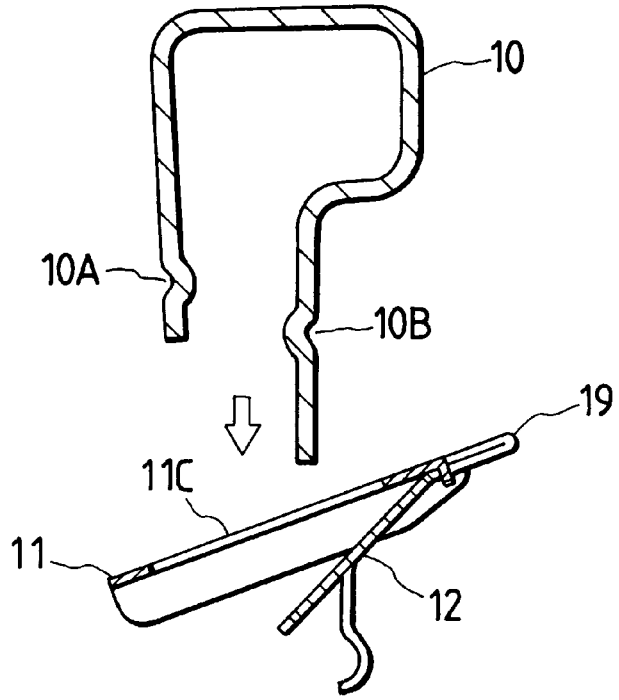
FIG. 8(*a*) is a cross sectional view which shows a process of installing a holder to a single plate bent double which forms a movable member and a contact member according to the fourth embodiment of the invention.
Figure 8B:
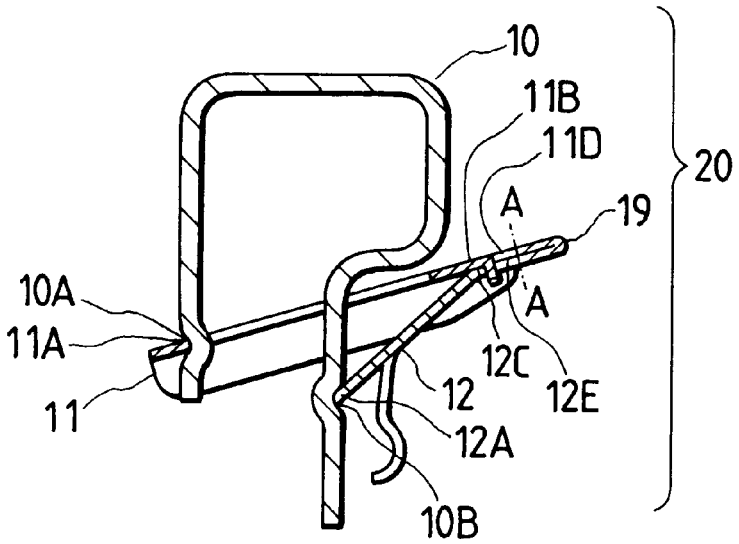
Figure 9:
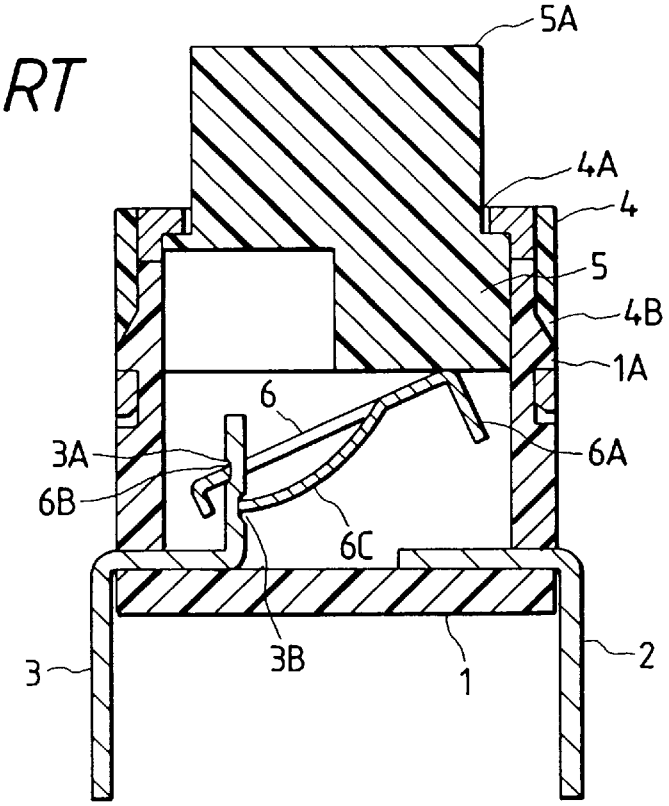
FIG. 9 PRIOR ART
FIG. 9 is a cross sectional view which shows a conventional push-button switch.
Figure 10:
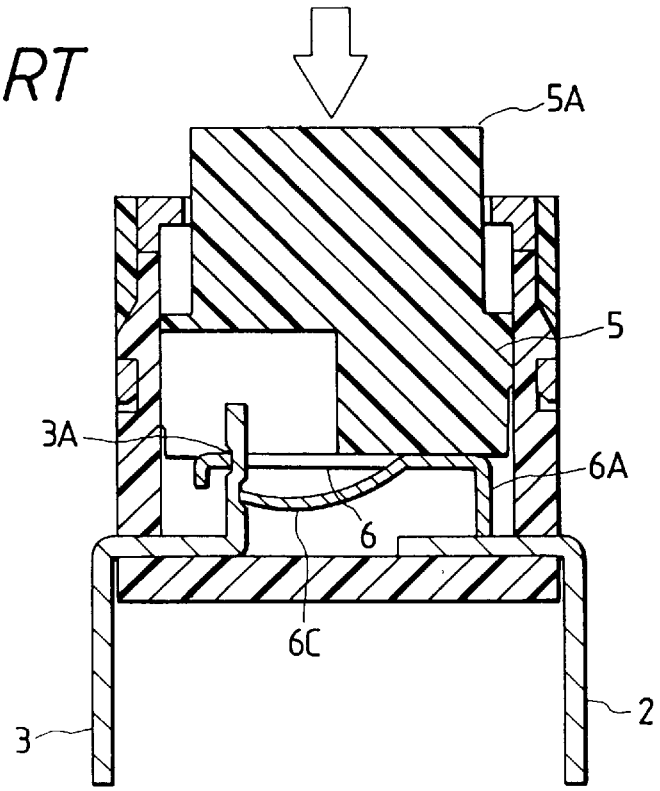
FIG. 10 PRIOR ART

FIGS. 8(*a*) and 8(*b*) show a push-button switch according to the fourth embodiment of the invention which is different from the first embodiment only in a process of forming the movable member 11 and the contact member 12. Other arrangements are identical, and explanation in detail will be omitted here.

In assembling processes of the push-button switch, the movable member 17 and the contact member 18 are, as shown in FIG. 8(*a*), made of a single plate doubled up at bent portions 19. The holder 10 is deformed inwardly at both ends and inserted into the opening 11C of the movable member 11 to have the inner edge 11A of the movable member 11 and the cut-out portion 12B of the contact member elastically fitted into the curved portions 10A and 10B, respectively. Afterwards, the bent portions 19 are cut at lines A—A, as shown in FIG. 8(*b*), and divided into the ends 11D of the movable member 11 and the ends 12E of the contact member 12, as shown in FIGS. 3 and 4. The movable member 11 and the contact member 12 are connected to each other, similar to the above embodiments, by engagement of the cut-out portion 12C with the L-shaped end portion 11B. In this manner, a contact assembly 20 is formed. The contact assembly 20 is put into the casing 21 to complete the push-button switch.

The movable member 11 and the contact member 12 are, as described above, finished after the holder 10 is fitted into the single plate doubled up, thus shortening a working time required for assembling the push-button switch as compared with the above embodiments.

While the present invention has been disclosed in terms of the preferred embodiment in order to facilitate a better understanding of the invention, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A push-button switch comprising:

a casing having an upper opening, a side wall, and a bottom wall, said casing defining therein a chamber;

stationary contacts mounted in the chamber of said casing; a a holder made of a C-shaped elastic member having a first end portion and a second end portion, said holder being secured at the first end portion in the bottom wall of said casing to retain the second end portion above the bottom wall of said casing;

a movable member having a first end portion and a second end portion, said movable member connecting at its second end portion with the second end portion of said holder;

a contact member having elastic arms on ends of which movable contacts are formed, said contact member having a first end portion and a second end portion and connecting at its first end portion with the first end portion of said movable member and at its second end portion with the first end portion of said holder so as to support the movable contacts at a given interval away from said stationary contacts, respectively; and a knob disposed slidably in the chamber of said casing with a head projecting from the upper opening, said knob having a bottom wall in engagement with said movable member, when the head is depressed, the bottom wall of said knob urging said movable member to bring the movable contacts into electrical engagement with said stationary contacts while deforming said holder elastically.

2. A push-button switch as set forth in claim 1, wherein when the head of said knob is depressed, the bottom of said knob urges said movable member to bring the movable contacts into electrical engagement with said stationary contacts while moving the second end portion of said holder close to the first end portion of said holder.

3. A push-button switch as set forth in claim 1, wherein the movable contacts of said contact member are in contact with inclined surfaces formed on the bottom wall of said casing so that when the head of said knob is depressed, the movable contacts of said contact member slide along the inclined surfaces and engage said stationary contacts to establish electrical communication between said stationary contacts.

4. A push-button switch as set forth in claim 1, wherein said knob has formed therein a chamber within which said holder is disposed.

5. A push-button switch as set forth in claim 1, wherein the first end portion of said holder continues from an end of one of said stationary contacts.

6. A push-button switch as set forth in claim 1, wherein said casing has a protrusion formed on an inner end surface of the side wall, and wherein said knob has a protrusion formed on an outer surface which engages the protrusion of said casing within the chamber of said casing.

7. A push-button switch as set forth in claim 6, wherein the protrusion of said knob engages the protrusion of said casing against a spring pressure produced by said movable member and said contact member.

8. A process of fabricating a push-button switch including:

a casing having an upper opening, a side wall, and a bottom wall, said casing defining therein a chamber, stationary contacts mounted in the chamber of said casing, a holder made of a C-shaped elastic member having a first end portion and a second end portion, said holder being secured at the first end portion in the bottom wall of said casing a movable member having a first end portion and a second end portion, said movable member connecting at its second end portion with its second end portion of said holder, a contact member having elastic arms on ends of which movable contacts are formed, said contact member having a first end portion and a second end portion and connecting at its first end portion with the first end portion of said movable member and at its second end portion with the first end portion of said holder so as to support the movable contacts at a given interval away from said stationary contacts, respectively, and a knob disposed slidably in the chamber of said casing with a head projecting from the upper opening, said knob having a bottom wall in engagement with said movable member, when the head is depressed, the bottom wall of said knob urging said movable member to bring the movable contacts into electrical engagement with said stationary contacts while deforming said holder elastically, said process comprising the steps of:

forming said movable member and said contact member using a single plate doubled up at a bent portion;

connecting said holder to said single plate; and cutting the bent portion of said single plate to divide said single plate into said movable member and said contact member.

* * * * *